United States Patent [19]

Bonham et al.

[11] 4,436,045

[45] Mar. 13, 1984

[54] DIFFERENTIAL FEED MECHANISM FOR SEWING MACHINES

[75] Inventors: Richard T. Bonham, Oak Park; John P. Sigiols, Chicago; Paul H. Dinkelacker, Hillside, all of Ill.

[73] Assignee: Union Special Corporation, Chicago, Ill.

[21] Appl. No.: 378,147

[22] Filed: May 14, 1982

[51] Int. Cl.[3] ..... D05B 27/08

[52] U.S. Cl. ..... 112/313

[58] Field of Search ..... 112/313

[56] References Cited

U.S. PATENT DOCUMENTS 3,382,827 5/1968 Von Hagen ..... 112/313

3,450,079 6/1969 Lukin ..... 112/313

3,611,817 10/1971 Smith ..... 112/313

*Primary Examiner*—Werner H. Schroeder

*Assistant Examiner*—Andrew M. Falik

*Attorney, Agent, or Firm*—John W. Harbst; John A. Schaerli

[57] ABSTRACT

A differential feed mechanism is provided for a high speed industrial sewing machine. The differential mechanism includes separate driving mechanisms for each of the two feed dogs mounted on separate feed bars, both mechanisms being driven from a common input shaft. Separate adjusting devices are provided for each of the feed dog driving mechanisms to adjust individually, rapidly and at will, the length of the horizontal feed stroke of each feed dog.

3 Claims, 12 Drawing Figures

FIG. 11
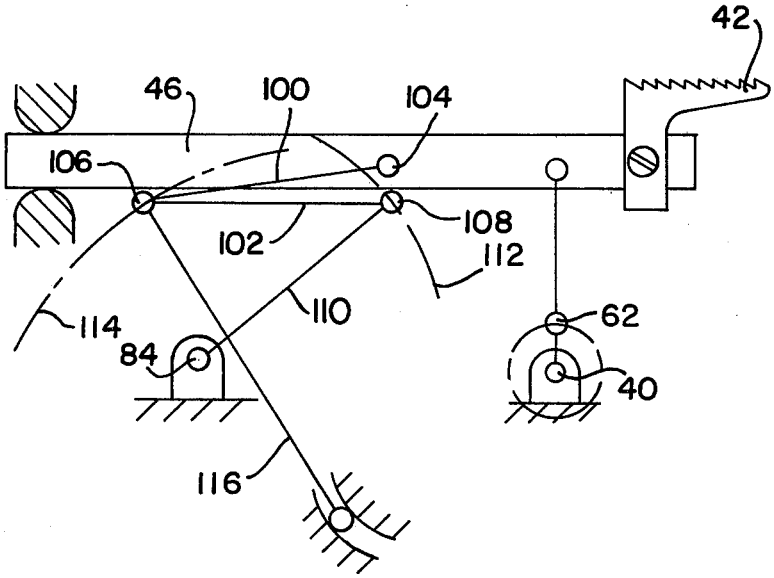
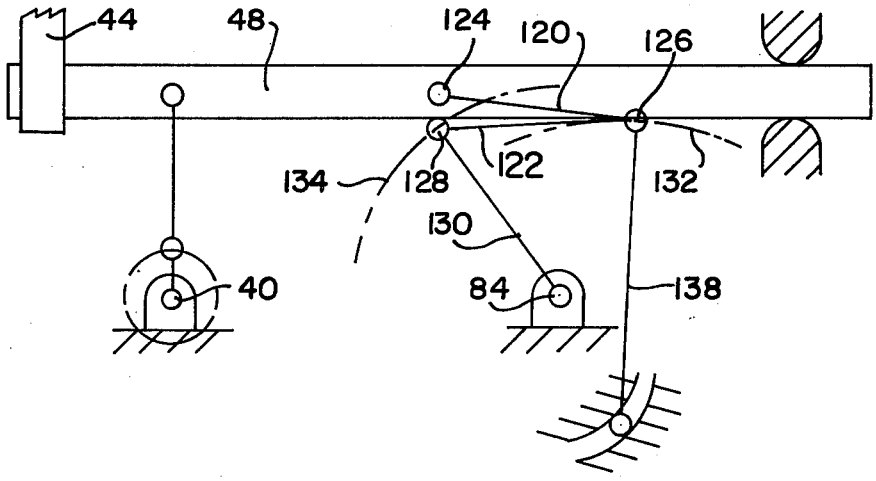
FIG. 12

DIFFERENTIAL FEED MECHANISM FOR SEWING MACHINES

The present invention relates to industrial sewing machines, and, more particularly, to an improved differential feed mechanism for an overedge sewing machine.

A principal object of the invention is to provide a simple, compact, and sturdy sewing machine capable of operation at high speeds, e.g. 8,000 to 9,000 or more stitches per minute without objectionable noise or vibration and in which the work feed mechanism is of the differential type having an improved means for imparting horizontal feed motion to a main feed dog and auxiliary or differential feed dog carried on separate feed bars.

Another object of the invention is to provide a differential feed mechanism for an overedge sewing machine having provision for adjusting the length of the horizontal or feed stroke of each feed bar individually and in a precise and controllable manner.

Still another object of this invention is to provide a differential feed mechanism for a sewing machine in which the driving connections for each feed bar are from a common input shaft and separate from each other.

Another object of the invention is the provision of an easier and thus cheaper means of manufacture.

Still another object of the invention is to enable the mechanism to undergo higher loads since it is mostly in compression and tension rather than bending.

Yet another object of the invention is to enable the mechanism to hold tighter tolerances, because of pin jointed holes replacing slotted link.

Still a further object of the invention is to provide a quieter mechanism because heretofore known curved links opened up under high speeds and have been replaced by a superior linkage system.

Another object of the invention is to provide easier obtainment of zero stitch length or reverse feeding.

Still another provision of this invention is a unique manner and means for thrusting of the main and auxiliary feed bars.

Yet another object of this invention is for the feed curve to grow outward to one direction.

A feature of the present invention is the provision of a new and improved differential feed mechanism having a main feed dog and an auxiliary or differential feed dog carried on respective feed bars arranged in a side by side relationship. A common mechanism is provided for both feed bars to impart a vertical movement to the feed dogs. Similar but separate driving mechanisms are provided for each of the two feed bars for effecting horizontal movement of the feed dogs. Similarly, separate feed adjustment means for individually adjusting the feed or horizontal stroke length of each feed bar is also provided.

Another feature of the invention is the provision of adjusting means and control means for quickly and intermittently varying the horizontal feed stroke of at least one of the two feed bars during operation of the sewing machine and providing a limit of the variation of the feed stroke to a preselected minimum and maximum which may be changed at the will of the operator at any time even during the operation of the sewing machine.

Still another feature of the invention is the provision of a differential feed mechanism having a pair of feed bars, a feed dog carried on each of the feed bars and drive means for each of the feed bars which comprise separate connections, from a common drive shaft to each feed bar, in spaced relation to each other. The mechanism for separately adjusting the horizontal stroke length of the feed bars comprises a pair of crank means coaxially arranged on a control shaft with one of the two crank means being rigidly fixed and the other loosely supported thereon for carrying into effect the adjustment of each feed bar individually in response to a respective actuation of an operator controlled, micrometer type control means.

Having in mind the above objects and other attendent advantages that would be evident from an understanding of this disclosure, the invention comprises the devices, combinations, and arrangement of parts as illustrated in the presently preferred embodiment of the invention which is hereinafter set forth in detail to enable those skilled in the art to readily understand the functions, operation, construction and advantages of it when read in conjunction of the accompanying drawings in which:

FIG. 11 is a schematic representation of the main feed mechanism;

FIG. 12 is a schematic representation of the auxiliary feed mechanism.

DETAILED DESCRIPTION OF THE PREFERRED EMBODIMENT

Figure 1:
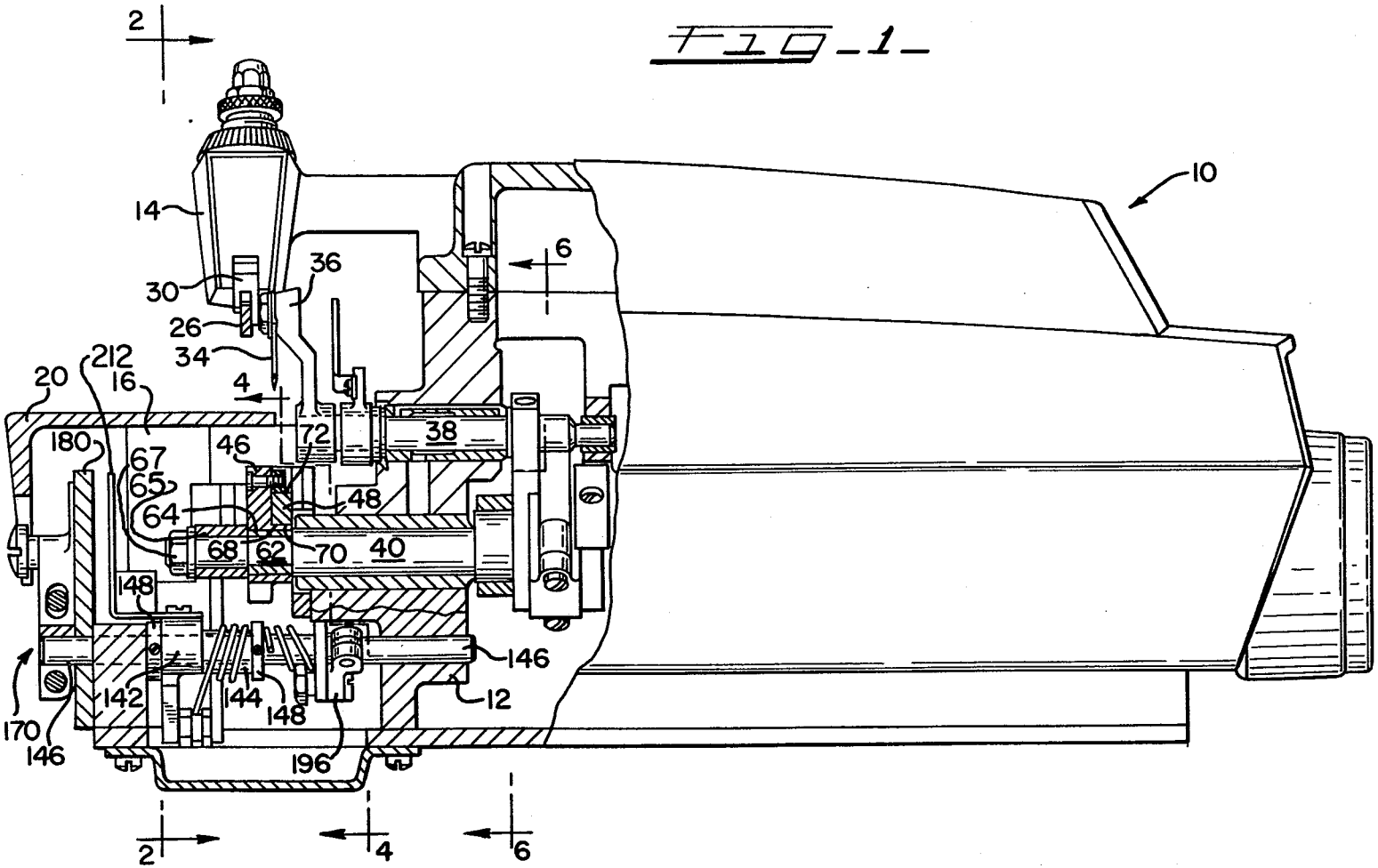
FIG. 1 is a front elevational view, partly in section of a machine incorporating the present invention.

Referring now to the drawings, wherein like reference numerals indicate like parts throughout the several views, the improved feed mechanism herein under consideration is shown as applied to a sewing machine 10 having a frame or housing 12 comprising a head portion 14 and work support portion 16. On its underside, the machine is provided with a closure plate 18 which serves as a means for supporting the machine from a table or stand (not shown). A cloth plate 20 is rotatably positioned on top of the supporting frame portion in a conventional manner and carries a throat plate 22. During operation of the machine, the workpiece being sewn is moved across the cloth plate and is held against the throat plate by a pressor foot assembly 24 carried on the distal end of an arm 26. The other end of arm 26 is mounted in a universal joint 28. The arm 26 is engaged by a spring biased member 30 whereby the pressor foot is urged toward the cloth plate and throat plate. Conventional means (now shown) may be provided for raising the arm 26, in opposition to the spring biased means 30, to permit introduction or adjustment of the workpiece beneath the pressor foot assembly.

The stitch forming instrumentalities , as far as shown, include needle means 34 mounted at the free end of a carrier 36. The other end of carrier 36 is clampled to a rock shaft 38 which is arranged to be rocked upon each revolution of the main drive shaft 40 of the machine ultimately effecting endwise reciprocation of the needle means 34. Suitable stitch forming implements or looper means cooperate with the needle means to effect the formation of over seaming stitches. But as these loopers, including the manner of and means for their actuation, form no part of the present invention, their illustration and further detailed description are not deemed necessary. Other details of the actual machine, which are not shown for purposes of clarity, include a workpiece trimming means disposed in advance of the zone in which the stitch forming instrumentalities or devices serve to produce overedge stitches. For a more complete description and illustration of the machine of the present type, reference may be had to U.S. Pat. Nos. 3,611,817 issued Oct. 12, 1971 and 2,704,042 issued Mar. 15, 1955, the full disclosures of which are incorporated herein by reference.

Figure 2:
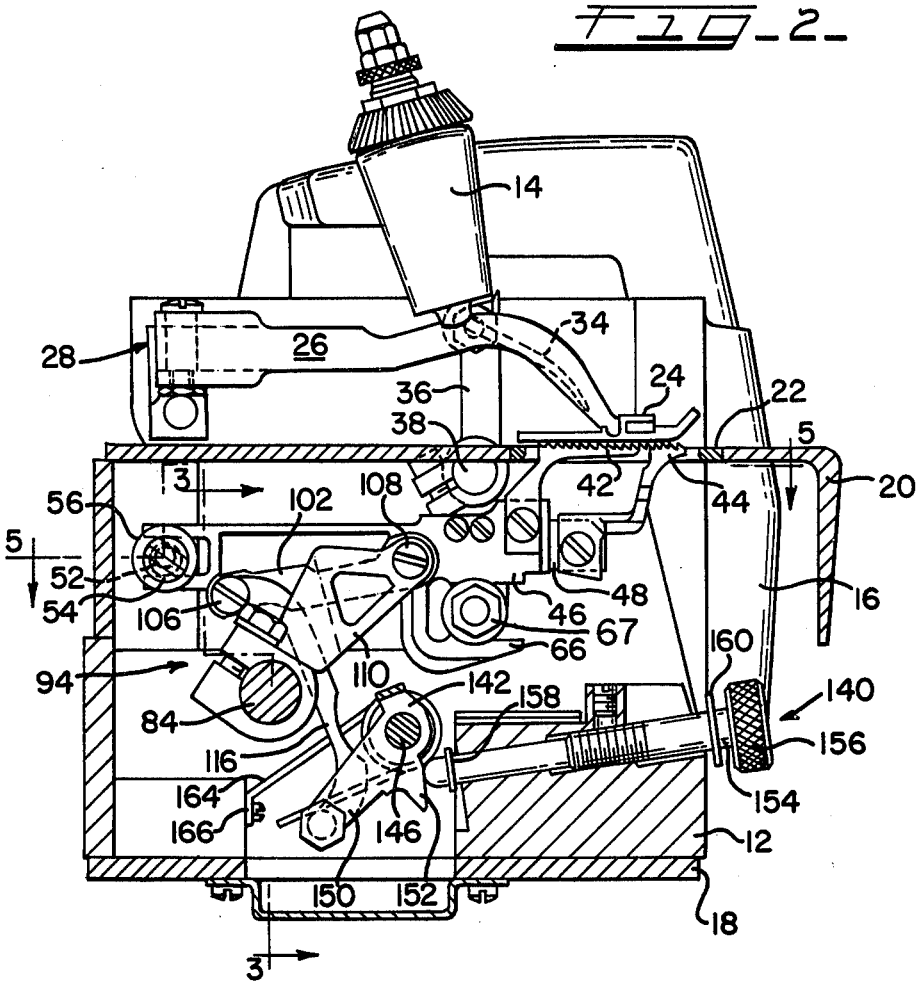
FIG. 2 is a side elevational view, partly in section, taken along Line 2—2 of FIG. 1.
Figure 5:
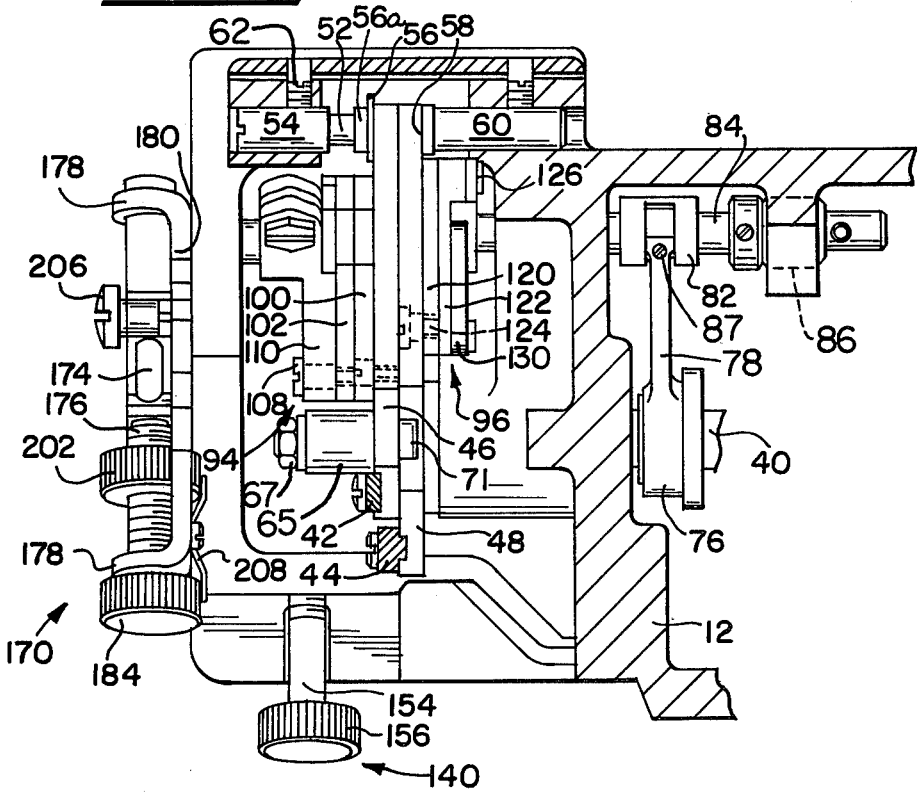
FIG. 5 is a horizontal sectional view, taken along Line 5—of FIG. 2.
Figure 7:
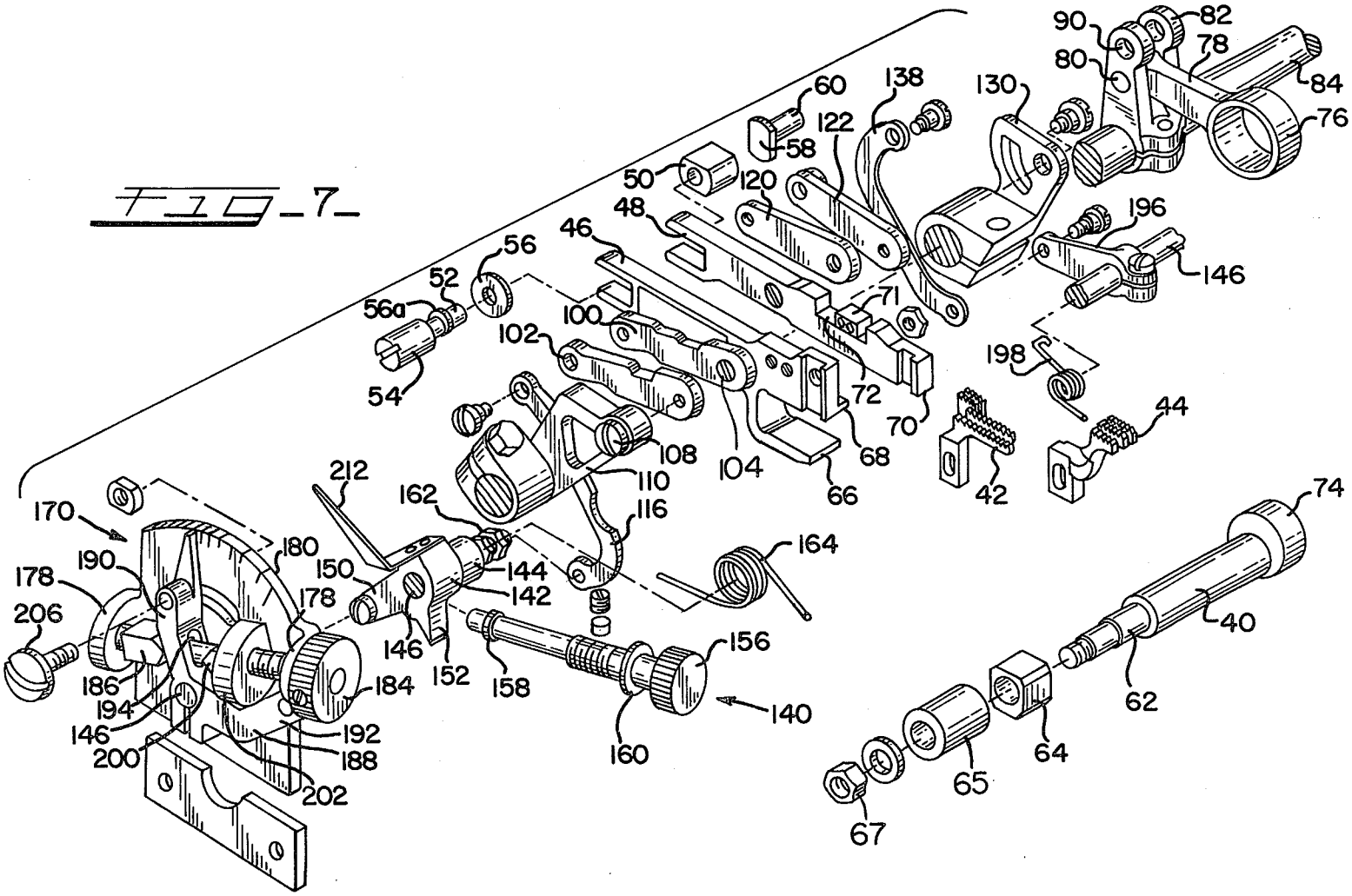
FIG. 7 is an exploded perspective view of the entire feed and feed adjusting mechanism of the present invention.

As may be best seen in FIGS. 2 and 7, the work feeding mechanism of the present invention is of the differential type including main feed dog means 42 and an auxiliary or differential feed dog means 44. It will be understood that both feed dog means intermittently rise above the level of the work supporting surface of the throat plate 22 through suitable openings provided therein so as to cooperate with the presser foot assembly 24 in advancing the workpiece in step by step translations over the work support means and past the needle means in the intervals when the latter is disengaged from the work. The main feed dog means 42 and the auxiliary or differential feed dog means 44 are mounted, respectively, on side-by-side main and auxiliary or differential feed dog carrier means 46 and 48. While the feed dog means are carried at the forward end of the feed bars, the rearward forked ends of each feed bar is slidably mated with a block 50 which, in turn, is carried on an eccentric portion 52 of an adjustable pin 54 rotatably received in a rear wall of the machine frame. As seen in FIG. 5, lateral or sidewise movement of the feed bars is prevented in one direction by a washer means 56 which sits against a collar **56*a* provided on the pin 54 and in the other direction by an adjustable thrusting surface 58 provided by a pin 60. The pin 60 being adjustably received in another portion of the rearward wall of the machine frame. The pin 54 may be rotated to vary the elevation of its eccentric portion 52 and locked in any desired position by fasteners 62. Suffice it to say, the bars or carriers 46 and 48 both oscillate and move longitudinally about and relative to the axis of the eccentric portion 52 of pin 54, which axis is common to both of the feed bars. By this construction, the location of the eccentric axis of pin 54 will determined, in part, the path of the feed bars 46 and 48**.

The feed bar means and feed dog means carried thereby are given the usual "rising" and "falling" movements by a feed lift eccentric 62 arranged on the main drive shaft 40. In the preferred embodiment, the eccentric portion of the main drive shaft is surrounded by bearing block 64 which, in turn, is embraced by a yoke 66 depending from the main feed bar 46. A collar 65 and nut 67 prevent axial displacement of the bearing block along the eccentric portion of the main shaft. The auxiliary feed bar 48 is slideably interconnected to the main feed bar such that the vertical lift of the main feed bar is simultaneously imparted thereto. In the preferred form, the sliding interconnection of the feed bars is accomplished by providing the main feed bar with a laterally extending flat portion 68 which is adapted to engage the flat undersurface 70 of the auxiliary feed bar 48. A flat upper surface 72 on the auxiliary feed bar engages a slide block 71 fixedly carried by the main feed bar 46. Thus, the auxiliary feed bar is constrained to move in a vertical direction simultaneously with the vertical movements of the feed bar 46 but is free to independently move longitudinally of the feed bar 46. It will be understood that rotation of the main drive shaft will cause the block 64 to move in a circular path and impart rising and falling motion to the forward end of the feed bars. As the block 64 slides in the yoked portion 66 of the feed bar 46 it will impart no forward or reverse motion to either of the feed bars.

Figure 3:
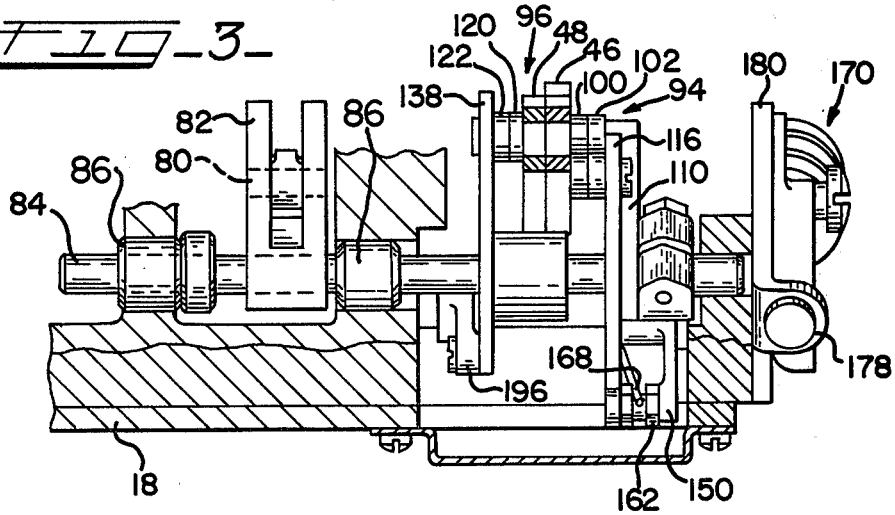
FIG. 3 is a vertical sectional view of the differential feed mechanism shown in FIGS. 1 and 2 and taken substantially along Line 3—3 of FIG. 2.
Figure 6:
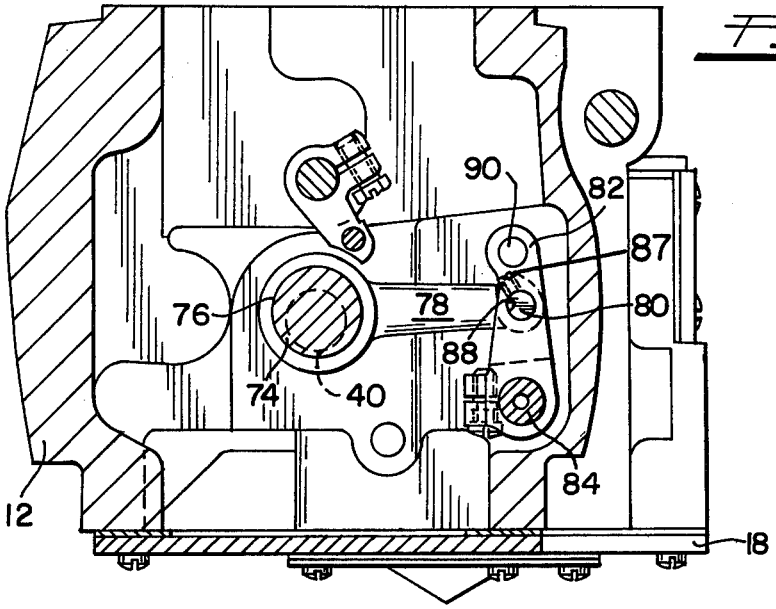
FIG. 6 is a vertical sectional view taken along substantially along Line 6—6 of FIG. 1 showing the driving connections for imparting horizontal movement to the feed mechanism of the present invention.

Having now described the means for providing vertical motion to the main and auxiliary feed bars, the means for imparting independent horizontal motion to each of the feed bars will now be described. As best seen in FIGS. 5, 6 and 7, the feed and return movements are imparted to each of the feed bars from a feed eccentric 74 mounted on the main shaft 40. An eccentric strap connection 76 having a pitman extension 78 is pin connected, as at 80, to one end of driving lever 82. The other end of the driving lever 82 is rigidly secured to a rock shaft 84. As seen in FIG. 3, the rock shaft 84 is journaled for rotatory movement in the frame of the machine in suitable bearings 86 provided at points adjacent the ends of the shaft 84. Thus, rotation of the main drive shaft 40 will place rock shaft 84 into an oscillatory motion. The pin connection between the pitman extension and the driving lever is maintained by a fastener 87 which constrains the pin against axial movement. Alteration of the amplitude of oscillatory movement imparted to the rock shaft 84 may be affected by changing the location of the pin connection 80 relative to the central axis of the rock shaft 84. For this purpose, the drive lever may be designed with two sets of bearing holes 88 and 90 to provide an adjustment in the degree of oscillation of the rock shaft 84.

The motion of the rock shaft 84 is transferred or imparted to each of the two feed bars 46 and 48 by first and second independent linkage assemblies 94 and 96, respectively. For purposes of this disclosure, let it be said that the first linkage assembly 94 drives the main feed bar means 46. It follows therefore, that the second linkage assembly 96 would drive the auxiliary or differential feed bar 48. In its presently preferred construction, the first linkage assembly includes two substantially equal drive lengths 100 and 102. At one end, link 100 is pivotally connected to the main feed bar as at 104 via a shoulder screw. From its pivotally connection with the feed bar means 46, the link 100 extends rearwardly in the direction of feed, and is articulatly connected, as at point 106, to the other drive link means 102. The second link 102 extends from its pivotal connection 106 with the link 100 and is pivotally connected, as at 108, to one end of a rocker driver 110. The other end of the rocker link 110 is fixedly secured to the rocker shaft 84. From this, it is to be understood that the oscillatory rocking motion of the rock shaft 84 will affect feed and return movements of the main feed dog means 42 through the medium of the rocker link 110, drive links 100 and 102, and feed dog carrier 46. Also, the construction of the rocker drive link 110 allows it to act as a means for thrusting the main feed bar 46 and its respective drive links in one lateral direction.

As may be best viewed in FIG. 11, when considering the kinematics of the first linkage assembly 94, it is evident that the affect of oscillating the thrusting rock shaft 84 is that oscillatory movement will be created at point 108 on rocker link 110 which is constrained to move along the arc of a circle generally indicated as 112. The rocking motion of the drive link 110 is resolved into endwise movement of the feed bar 46 by the drive links 100 and 102. That is, the rocking motion of the drive link has a horizontal component of movement that is imparted to the drive link 102. The point 106 whereat the link 102 is connected to link 100 is constrained to move along a predetermined path generally in the arc of a circle indicated at 114, owing to a positive guiding by an anchor link 116. The function and operation of anchor link 116 will be discussed hereinafter. Because link 100 is pin connected to the drive link 102, the drive link 100 is obliged to move with the driven link 102 and imparts a transverse feed motion to the feed dog carrier 46 whereby moving the feed dog in a horizontal direction so as to impart an advancing motion to the work.

The second or differential drive link assembly 96 is substantially similar in constructon to the first drive assembly. That is, the second link assembly includes two substantially equal drive links 120 and 122. The drive link 120 is privotally secured to the auxiliary feed dog carrier 48 as at point 124. From its pivotal connection with the feed dog carrier 48, the link 120 extends rearwardly in the direction of feed and is articulated as at point 126 to the other drive link 122. The second drive link 122 extends from its pivotal connection with the drive link 120 and is privotally connected, as at 128, to one end of a thrusting rocker drive link 130. The other end of the rocker drive link 130 is fixedly secured to the rocker shaft 84. Thus, feed and return movement for the differential feed dog 44 are derived from the oscillatory rocking movement of the common rock shaft 84 and are imparted through the medium of rocker drive link 130, drive links 120 and 122 and differential feed dog carrier means 48. Furthermore, as with rocker drive link 110, the construction of the rocker drive link 130 allows it to act as a means for thrusting the auxiliary feed bar 48 and its respective drive links, in a direction opposite to that affected by the thrusting action of the rocker drive link 110.

Turning now to the schematic illustration of the seconk linkage assembly shown in FIG. 12, it is evident that the affect of oscillating the rock shaft 84 is that oscillatory movement will be created at point 128 on rocker drive link 130, which point is constrained to move along the arc of a circle generally indicated as 134. The rocking motion of the drive link 130 is resolved into endwise movement of the auxiliary or differential feed bar 48 by the two drive links 120 and 122. That is, the rocking motion of the drive link 130 will impart a horizontal component of movement to the drive link 122. The point 126 whereat the drive link 122 is connected to drive link 120 is constrained to move along a predetermined path, generally sweeping out the arc of a circle generally indicated at 132, owing to the positive guiding by a anchor link 138. The function and operation of link 138 will be discussed in detail hereinafter. Because the link 122 is pin connected to drive link 120, the drive link 120 is obliged to move with the link 122. The movement of the link 120 imparts a transverse feed motion to the feed dog carrier 48 whereby moving the differential feed dog means in a horizontal direction so as to impart an advancing motion to the workpiece.

Because the drive trains for the main and auxiliary feed mechanisms are substantially independent of one another, it should be appreciated that the amount of lengthwise movement transmitted to the particular feed bar from any given degree of oscillation of the rock shaft 84 is dependent upon the particular predetermined arcuate path of the respective drive lengths. We turn now to the control means for adjusting the horizontal feed stroke of the feed bars. Adjustment of the feed stroke of the main feed bar or carrier means 46 is accomplished by controlling the fulcrumed disposition of the drive links 100 and 102; that is, controlling the disposition of the pivot point 106. As is readily appreciated in the art of kinematics, the disposition of the pivot point 106 will determine the path of oscillation of the drive links, and hence, the magnitude of horizontal movement that is imparted to the feed bar 46. For affecting this adjustment of the drive link fulcrum, the present invention is provided with an operator controlled mechanism 140 for the main feed mechanism of the machine. The controlled mechanism 140 includes the anchor link 116 which is connected at one end to the fulcrum point 106 of links 100 and 102 and a bell crank lever means 142. In the preferred embodiment, the lever means 142 has a central sleeve portion 144 that is arranged for free rotation about the center axis of a control shaft 146. Suitable collar means 148 constrain the axial displacement of the lever means 142 along the axis of the control rock shaft 146. The rock shaft 146 extends below and parallel with rock shaft 84 and main shaft 40 and is journaled for rotary movement in the machine frame. One arm 150 of the bell crank lever means 142 is articulated to the depending end of the anchor link 116. The other arm 152 of lever means 142 communicates with an operator controlled member 154. Adjustment of the feed stroke of the main feed bar is accomplished by turning the adjustable member or rod 154 clockwise or counter clockwise as may be desired. As seen in FIG. 2, the adjustable member 154 is threaded into a suitable bore provided in the machine frame. The member 154 is situated such that it is directed at the arm 152 of lever means 142. As might be expected, clockwise rotation of the rod 154 will cause it to move inwardly and, in engaging the arm 152 of the bell crank lever, will cause the lever to be rotated about the central axis of the control shaft 146. In like manner, counter clockwise rotation of the adjustment rod 154 will result in the withdrawal of the adjustment member 154 whereby permitting the bell crank lever 142 to rotate in a counter clockwise direction. If preferred, the adjustment rod 154 may be provided with a knurled knob 156 for the convenience of the operator. The adjustment rod 154 is also provided with stops 158 and 160 for limiting the linear displacement of the rod 154. From the foregoing, it will be understood that the rotary movement of the bell crank lever about the control shaft ultimately affects the fulcrumed disposition of point 106, the predetermined oscillatory path of the drive links 100 and 102 and ultimately the magnitude of horizontal feed imparted to the main feed bar 46 by the first linkage assembly.

As best seen in FIG. 3, the depending end of anchor link 116 and the arm 150 of the bell crank lever 142 are spaced apart yet joined by a fastener 162. Turning now to FIG. 2, a coiled spring 164 wrapped about the control shaft 146 has one free ended portion 166 anchored to the machine frame while the other end engages the fastener 162. By this construction, the bell crank lever 142 is normally urged in a counter clockwise direction with the arm 152 being maintained against the end of the adjustable member 154. Thus, a positive stop is provided for the bell crank lever 142.

A similar type of control is provided for the auxiliary or differential feed bar 48. The adjustment in this case comprises two basic settings, a maximum and minimum setting. The minimum or normal setting provides for a minimum feed stroke of the differential feed bar while the maximum setting provides for a maximum feed stroke. As the minimum feed stroke of the auxiliary feed bar can be smaller than the feed stroke of the main feed bar a stretching of the material during the feeding action can be achieved while, on the other hand, the maximum setting of the auxiliary feed bar can be equal to the feed stroke length of the main feed bar in which case no differential feeding would be transacted during the activation of the maximum setting. If desired, however, the minimum feed stroke of the auxiliary feed bar could be made to match the feed stroke of the main feed bar while the maximum feed stroke could be increased to cause shirring or gathering of the material. Of course, many variations of the relationship between the two feed stroke lengths of the auxiliary feed bar and the one feed stroke of the main feed bar can be brought about by adjusting the feed stroke length of either one or the other of the two feed bars.

Figure 8:
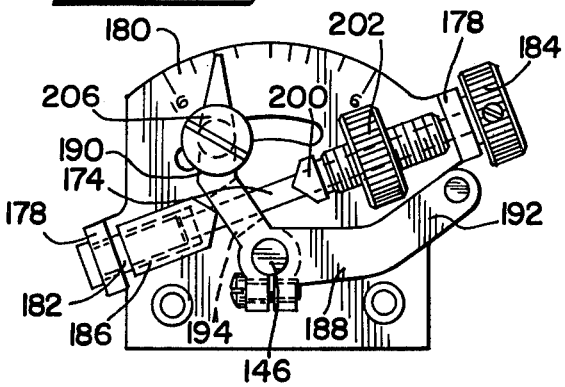
FIG. 8 is a fragmentary side elevational view of the operator controlled actuating means for adjusting the horizontal feed stroke of the auxiliary feed means.
Figure 10:
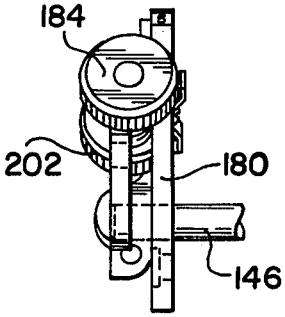
FIG. 10 is a fragmentary elevational view of the operator controlled actuating means shown in FIG. 8.

An operator controlled adjustment mechanism 170 for the auxiliary or differential feed mechanism comprises a mechanism for setting the minimum feed stroke and a mechanism for setting the maximum feed stroke of the differential feed bar means 48. The adjustment means are best shown in FIGS. 7, 8, 9 and 10 and include a pair of concentric screw elements comprising an inner rod 174 and an outer sleeve 176 slideably received on the rod. Rod 174 is journaled for rotation in a pair of flanges 178 which extend laterally and at right angles to an indicia plate 180 secured, as seen in FIG. 1, to the left end of the machine frame. The bearing lobes 178 are so arranged that the rod 174 is carried in an oblique direction extending generally parallel with the adjustment member 154. The rear or lower end of the rod 174 carries a threaded sleeve 182. The rod may also be provided with a knurled knob 184 provided at the other end for the convenience of the operator in turning same. Both the knurled knob 184 and the sleeve 182 are secured to the rod and rotate therewith. A lower stop block 186 is threaded on the sleeve 182. The stop block 186 is provided with flat face closely spaced from the indicia plate 180 such that the stop block will not rotate with the rod 174 but is contrained to move linearly along the rod 174 when the latter is rotated. As best shown in FIGS. 7 and 8, the stop block 186 acts to limit the counter clockwise rotation of a differential feed adjustment lever 188 which is fastened to the protruding end of the control shaft 146. The adjustment arm 188 is in the form of a bell crank having an arm 190 extending generally upward from the control shaft 146 and an arm 192 extending forward from the control shaft. An elongated slot is provided in the arm 190 through which the rod 174 may extend.

Figure 4:
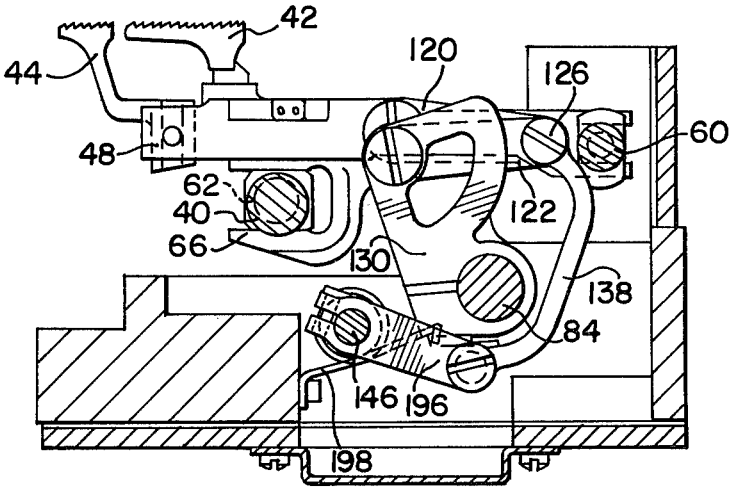
FIG. 4 is a vertical sectional view of the differential feed mechanism and operating means therefore, taken along Line 4—4 of FIG. 1.

Adjustment of the feed stroke of the auxiliary or differential feed bar 48 is accomplished by controlling the fulcrum disposition of the drive links 120 and 122; that is, controlling the disposition of the pivot point 126. As is readily appreciated by one skilled in the art of kinematics, the disposition of the pivot point 126 will determine the oscillatory path of the drive links and, hence, the magnitude of horizontal movement that may be imparted to the auxiliary feed dog carrier 48. For effecting this adjustment, the present invention is provided with the differential feed control mechanism 170. In addition to those components of the control mechanism 170 mentioned above, the differential feed control mechanism also includes the anchor link 138. At one end, the anchor link is connected to the fulcrum point 126 of drive links 120 and 122. At its lower depending end, the anchor link is connected to a crank arm 196 which is fastened to the control shaft 146. As shown in FIG. 4, a coil spring 198 is wrapped about the control shaft 146 and has one end portion anchored to the machine frame while the other end engages the crank arm 196. By this construction, the crank arm 196 is normally urged in a clockwise direction, as seen in FIG. 4, such that the feed stroke adjusting means of the differential feed mechanism is normally urged into such a position that it causes the driving means to impart a minimum stroke to the feed bars.

As seen in FIG. 8, the control shaft 146 is biased in a counter clockwise direction under the influence of spring 198. Thus, the arm 190 of the bell crank lever 188 is biased in a counter clockwise direction into engagement with the stop block 186. As the counter clockwise extreme position of the control shaft 146 determines the minimum horizontal feed of the auxiliary feed bar it will be apparent that the adjustment of the minimum feed of the auxiliary feed bar 48 is controlled by the setting of the stop block 186. For convenience of operation, the arm 190 also functions as a pointer which cooperates with the scale inscribed on the side of the indicia plate 180. Since the adjustment of the bell crank lever 188 is performed by a screw threaded means acting through the stop block 186, it is possible to have a micrometer type adjustment of the minimum feed of the auxiliary feed bar 48.

Figure 9:
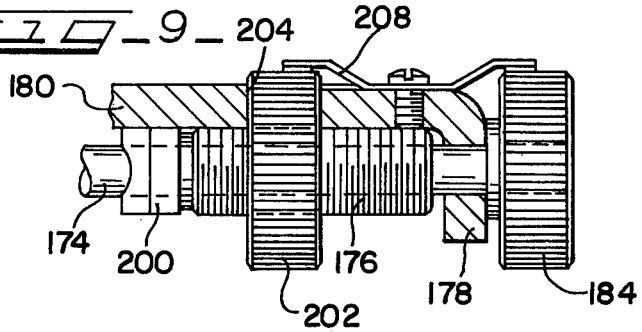
FIG. 9 is an enlarged fragmentary view of a portion of the feed control mechanism, taken substantially along Line 9—9 of FIG. 8.

It will now be apparent that as the bell crank lever 188 is rotated in a clockwise direction as seen in FIG. 8, against the force of the torsion coil spring 198 the horizontal feed of the differential feed bar will be increased corresponding to the angular movement of the bell crank 188 and the rotation of the control shaft 146. Rotation of the adjustment lever 188 about the axis of control shaft 146 may be accomplished by any suitable operator controlled means (not shown) such as a knee press or other suitable means connected with the arm 192 of the bell crank lever 188. The maximum length of the feed stroke of the auxiliary or differential feed bar is controlled by the extreme clockwise position of the bell crank lever 188. As best shown in FIGS. 8 and 9, clockwise motion of the bell crank 188 is limited by the position of a stop element 200 which forms a portion of the threaded outer sleeve number 176 which is concentric with the rotatable rod 174. Adjustment of the stop member 200 is provided through a knurled and threaded collar 202 which is loosely positioned in a slot 204 provided in the indicia plate 180. The knurled collar 202 is threaded onto the sleeve member 176 so that rotation of the collar 202 causes the sleeve member 176 to move linearly along the rod 174. The stop element 200 is formed with a flat surface adjacent the indicia plate 180 so that the stop member 200 and the sleeve member 176 are constrained against rotation. Since both adjustments of the auxiliary feed bar are screw actuated, adjustment micrometer type settings are provided for both extreme positions of the differential feed adjustment mechanism. A single fixed position of the bell crank lever 188 and thus the amount of disposition of the differential feed bar mean may be accomplished by securing the differential feed lever 188 in any desired position by means of a locking member 206. The provision of a double leaf spring 208 affixed to the indicia plate 180 prevents accidental movement of the adjustment rod by having the leaf spring engage the knurled surfaces of the knob 184 and collar 202.

Means are also provided for indicating the adjusted feed setting of the main feed dog means. Such means include an indicating finger 212 which is secured to the bell crank lever means 142 for rotation therewith. As seen in FIGS. 1 and 7, such finger extends upwardly from the lever means 142 and, like the pointer on the bell crank lever 188, cooperates with the scale inscribed on the side of the indicia plate 180 to indicate the adjusted feed setting of the main feed dog means 42.

Turning now to the operation of the differential feed mechanism according to the present invention. It will be understood that the operator may first adjust the adjustment member 154 in a clockwise or counter clockwise direction. Such turning of the adjustment member affects free turning movement of the bell crank lever 142 about the control shaft 146 and will affect the disposition of the fulcrum point 106 for drive links 100 and 102 and its predetermined oscillatory path. Upward or downward movement of the fulcrum point 106 will, respectively, increase or decrease the horizontal movement that is imparted to the drive links 100 and 102 and ultimately transmitted to the main feed dog carrier means 46. Sufficient modulation of the fulcrum point 106 may also affect reverse feeding. The operator continues to modulate the main feed length adjustment means until the indicia arm 212 indicates, with respect to the indicia on plate 180, that the correct and desired setting for the feed stroke for the main feed bar has been achieved. Next, the operator rotates adjustable member 170 to adjust the limit or stop means 186 until the desired minimum feed stroke length of the differential feed bar 48 is attained. The affect of rotating the adjustment member 170 is that the control shaft 146 is rotated. As a result of the rotation of control shaft 146, the crank arm 196 is moved in a manner affecting the disposition of the fulcrum point 126 for levers 120 and 122 and their predetermined oscillatory path. As with adjustment of the main feed drive, upward or downward movement of the fulcrum point 126 will, respectively, increase or decrease the horizontal movement that is imparted to the drive links 120 and 122 and is ultimately transmitted to the auxiliary or differential feed dog carrier means 48. As with the main feed adjustment, sufficient modulation of the fulcrum point 126 may affect reverse feeding. Alternatively, the minimum feed stroke may be less than, equal to, or more than the feed stroke length of the main feed bar depending on the desired end result. The operator then adjusts the maximum feed length attainable by the auxiliary feed bar by rotating the knurled collar 202. The maximum feed stroke will be determined by the adjustable position of member 200. If a fixed setting of the differential feed length is desired, the control shaft 146 may be present by adjusting the differential feed lever 188 and then locking same by use of locking member 206.

Having once adjusted the main and differential feed control mechanisms, the machine is prepared for operation. Rotary motion of the main drive shaft 40 is converted into oscillatory motion by the eccentric 74, strap 79 and pitman 70. The rock shaft 84, through the drive lever 82, is thus always given an oscillatory movement. The oscillatory movement of the rock shaft 84 is imparted to the rocker drive links 110 and 130 of the first and second linkage assemblies, respectively. The oscillatory motion of each drive link has a horizontal component. The operative connections from the rocker drive links to the feed bar is thus given this component of motion which, in turn, horizontally oscillates the associated feed bar. The amplitude of oscillation transmitted to each feed bar and thus to each feed dog is independently controlled by the disposition of the fulcrum point of each drive assembly as separately established by the main and differential feed drive adjustment assemblies described in detail above.

Thus there has been provided, in accordance with the invention, A Differential Feed Mechanism For Sewing Machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claim.

We claim:

1. In a sewing machine having a frame, a main drive shaft, reciprocatory needle means, and a differential feed mechanism comprising:

first and second feed dog carrier means arranged side by side and supported for oscillatory and reciprocatory movements relative to said frame;

means for interconnecting said first and second feed dog carrier means to permit relative horizontal movement between said carrier means and to prevent relative vertical movement of said bars;

eccentric drive means arranged on said drive shaft for imparting simultaneous vertical movement of said first and second feed dog carrier means;

first operative means interconnecting the drive shaft and said first feed dog carrier means for effecting reciprocatory horizontal movement of said first feed dog carrier means;

second operative means interconnecting the drive shaft and said second feed dog carrier means for effecting reciprocatory horizontal movement of said second feed dog carrier means;

each of said first and second operative means includes a means for converting the rotational movement of the drive shaft into oscillatory motion, a driving lever connected to said motion converting means to be oscillated thereby along a predetermined oscillatory path, linkage means including two interconnected and substantially equal links for connecting said driving lever to said feed dog carrier means for imparting reciprocatory horizontal movements thereto;

a first adjustment means communicating with said first operative means for varying the extent of reciprocatory horizontal movement of said first feed dog carrier means by controlling the oscillatory path of the driving lever of said first operative means; and a second adjustment means communicating with said second operative means for varying the extent of reciprocatory horizontal movement of said second feed dog carrier means by controlling the oscillatory path of the driving lever of said second operative means.

2. The invention of claim 1 wherein each of said driving levers include means for thrusting the first and second feed dog carrier means and their respective linkage means therebetween.

3. The invention according to claim 1 wherein said driving levers are so arranged relative to said feed dog carrier means and said linkage means so as to minimize overthrow of a feed dog carried at the distal end of each feed dog carrier means.

* * * * *